US009372015B2

(12) United States Patent
Lee et al.

(10) Patent No.: US 9,372,015 B2
(45) Date of Patent: Jun. 21, 2016

(54) HEAT PUMP SYSTEM CAPABLE OF ADJUSTING AMOUNT OF REFRIGERANT STORED IN LIQUID RECEIVER

(71) Applicant: KOREA INSTITUTE OF ENERGY RESEARCH, Daejeon (KR)

(72) Inventors: Gil Bong Lee, Daejeon (KR); Young Soo Lee, Daejeon (KR); Min Sung Kim, Daejeon (KR); Ki Chang Chang, Daejeon (KR); Jun Hyun Cho, Seoul (KR); Ho Sang Ra, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 126 days.

(21) Appl. No.: 14/324,308

(22) Filed: Jul. 7, 2014

(65) Prior Publication Data

US 2015/0020536 A1 Jan. 22, 2015

(30) Foreign Application Priority Data

Jul. 18, 2013 (KR) ..... 10-2013-0084665

(51) Int. Cl.

| | |
|---|---|
| ***F25B 13/00*** | (2006.01) |
| ***F25B 41/04*** | (2006.01) |
| ***F25B 43/00*** | (2006.01) |
| ***F25B 39/04*** | (2006.01) |
| ***F25B 49/02*** | (2006.01) |
| ***F25B 45/00*** | (2006.01) |
| *F25B 41/00* | (2006.01) |

(52) U.S. Cl.

CPC ..... *F25B 13/00* (2013.01); *F25B 45/00* (2013.01); *F25B 49/02* (2013.01); *F25B 41/003* (2013.01); *F25B 2400/16* (2013.01); *F25B 2600/2523* (2013.01); *F25B 2700/1931* (2013.01); *F25B 2700/1933* (2013.01)

(58) Field of Classification Search

CPC ..... F25B 45/00; F25B 2400/16; F25B 2600/2523; F25B 2700/1933; F25B 2700/1931

USPC ..... 62/324.4, 218, 324.6, 503, 509, 527, 62/528

See application file for complete search history.

(56) References Cited

U.S. PATENT DOCUMENTS

| | | | | |
|---|---|---|---|---|
| 2,641,109 | A * | 6/1953 | Muffly | 62/199 |
| 2,958,209 | A * | 11/1960 | Egon | 62/197 |
| 3,827,249 | A * | 8/1974 | Garland et al. | 62/174 |
| 4,718,245 | A * | 1/1988 | Van Steenburgh, Jr. | 62/196.4 |
| 2005/0097904 | A1 * | 5/2005 | Lifson et al. | 62/149 |
| 2011/0154847 | A1 * | 6/2011 | Itakura | 62/324.6 |

FOREIGN PATENT DOCUMENTS

KR 10-2007-0120214 A 12/2007

* cited by examiner

*Primary Examiner* — Frantz Jules
*Assistant Examiner* — Joseph Trpisovsky
(74) *Attorney, Agent, or Firm* — Paratus Law Group, PLLC

(57) ABSTRACT

A heat pump system includes a liquid receiver valve that adjusts the amount of a refrigerant stored in a liquid receiver so that a circulation amount of the refrigerant that circulates the heat pump system can be adjusted according to a driving speed of a compressor and performance of the compressor and the heat pump system can be further improved. Also, since a plurality of liquid receiver refrigerant outlets can be selectively opened using a pressure difference between an inlet and an outlet of the compressor, active control can be performed.

9 Claims, 6 Drawing Sheets

HEAT PUMP SYSTEM CAPABLE OF ADJUSTING AMOUNT OF REFRIGERANT STORED IN LIQUID RECEIVER

CROSS-REFERENCE TO RELATED PATENT APPLICATIONS

This application claims the benefit of Korean Patent Application No. 10-2013-0084665, filed on Jul. 18, 2013, in the Korean Intellectual Property Office, the disclosure of which is incorporated herein in its entirety by reference.

BACKGROUND OF THE INVENTION

1. Field of the Invention

The present invention relates to a heat pump system, and more particularly, to a heat pump system that is capable of adjusting a circulation amount of a refrigerant that circulates the heat pump system by increasing or decreasing the amount of the refrigerant of a liquid receiver according to a driving speed of a compressor.

2. Description of the Related Art

In general, a heat pump is a device that performs cooling or heating function using a refrigeration cycle in which a refrigerant is compressed, condensed, expanded and evaporated. A heat pump includes a compressor, a condenser, an evaporator, an expansion valve, and a 4 way valve. A liquid receiver is installed between the condenser and the expansion valve.

The liquid receiver performs a function of temporarily storing a liquid refrigerant condensed by the condenser and of smoothly supplying the refrigerant to the evaporator even when a cooling load or heating load varies. Korean Patent Publication No. 10-2007-0120214 discloses a liquid receiver.

However, in the conventional liquid receiver, it is difficult to adjust the amount of the refrigerant of the liquid receiver according to a driving speed of the compressor. Thus, a circulation amount of the refrigerant is insufficient when the compressor is rotated at a high speed, and the circulation amount of the refrigerant is excessive when the compressor is rotated at a low speed such that performance of the compressor and the heat pump system is lowered.

SUMMARY OF THE INVENTION

The present invention provides a heat pump system that is capable of increasing/decreasing the amount of a refrigerant of a liquid receiver according to a driving speed of a compressor.

According to an aspect of the present invention, there is provided a heat pump system including: a compressor; a condenser; an expansion unit; and an evaporator, further including: a liquid receiver which is disposed so that a refrigerant condensed by the condenser flows into the liquid receiver in a direction of gravity and in which a plurality of liquid receiver refrigerant outlets are formed at sides of the liquid receiver so as to be spaced apart from each other by a predetermined gap in the direction of gravity; and a liquid receiver valve that adjusts an amount of the refrigerant discharged from the liquid receiver by selectively opening the plurality of liquid receiver refrigerant outlets based on a pressure difference between an inlet and an outlet of the compressor.

According to another aspect of the present invention, there is provided a heat pump system including: a compressor; a condenser; an expansion unit; and an evaporator, further including: a liquid receiver which is disposed so that a refrigerant condensed by the condenser flows into the liquid receiver in a direction of gravity and in which a plurality of liquid receiver refrigerant outlets are formed at sides of the liquid receiver so as to be spaced apart from each other by a predetermined gap in the direction of gravity; a valve cylinder having one side connected to an outlet of the compressor and the other side connected to an inlet of the compressor; a valve piston that is disposed in the valve cylinder and selectively opens the plurality of liquid receiver refrigerant outlets by moving based on a pressure difference between both sides of the valve cylinder; a first compression spring that connects one side of the valve cylinder to one side of the valve piston so as to support an upward movement of the valve piston; and a second compression spring that connects the other side of the valve cylinder to the other side of the valve piston so as to support a downward movement of the valve piston, the second compression spring having larger rigidity than that of the first compression spring.

BRIEF DESCRIPTION OF THE DRAWINGS

The above and other features and advantages of the present invention will become more apparent by describing in detail exemplary embodiments thereof with reference to the attached drawings in which:

FIG. 2 is a view for describing a flow of a refrigerant when the heating of the heat pump system illustrated in FIG. 1 is on;

FIG. 3 is a view for describing a flow of the refrigerant when the cooling of the heat pump system of FIG. 1 is on;

DETAILED DESCRIPTION OF THE INVENTION

Hereinafter, embodiments of the present invention will be described with reference to the accompanying drawings.

Figure 1:
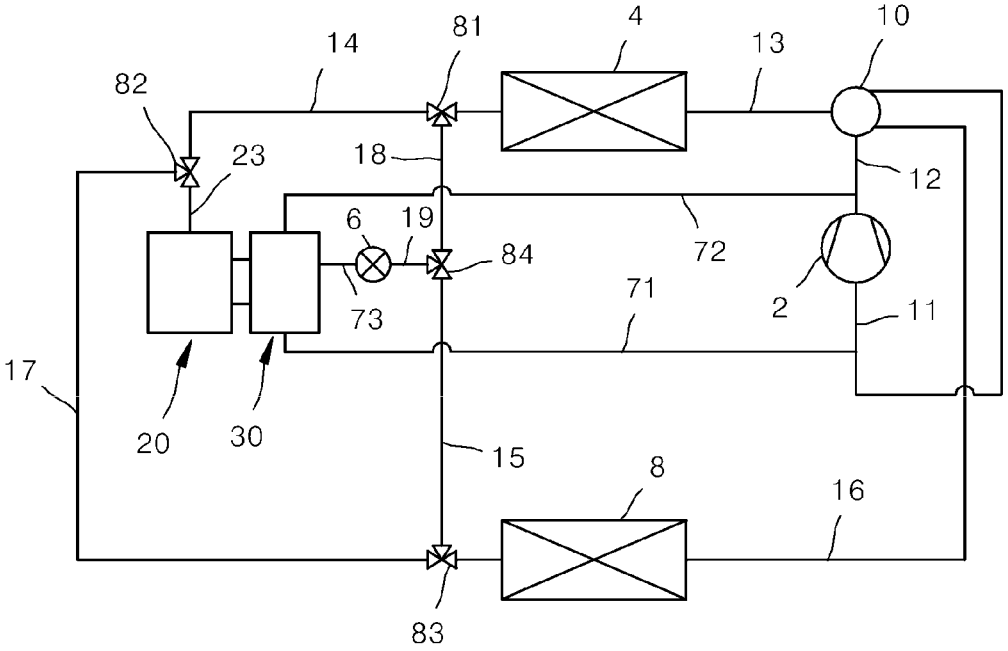
FIG. 1 is a view for describing a configuration of a heat pump system according to an embodiment of the present invention.
Figure 2:
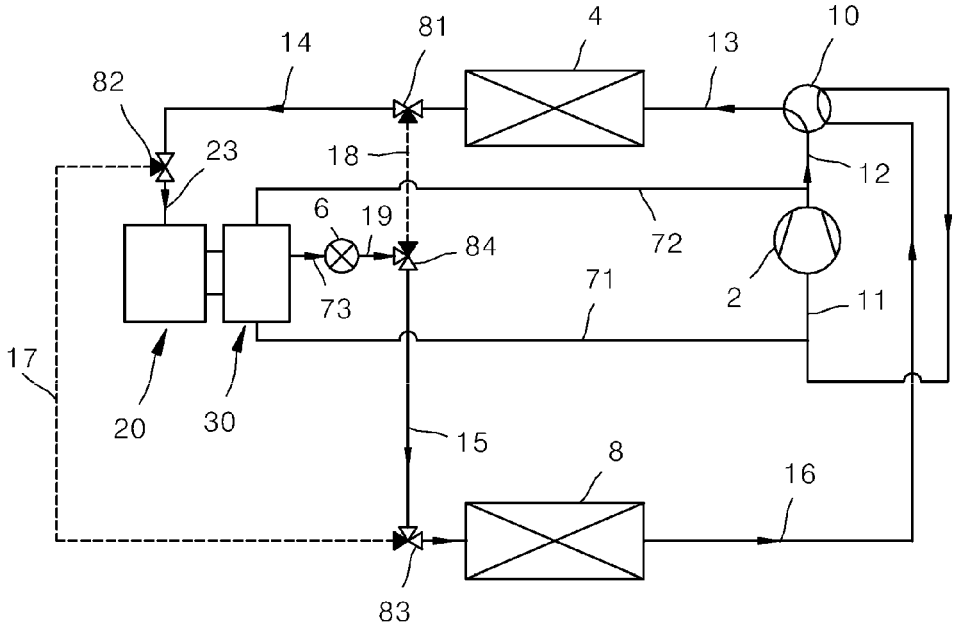
Figure 3:
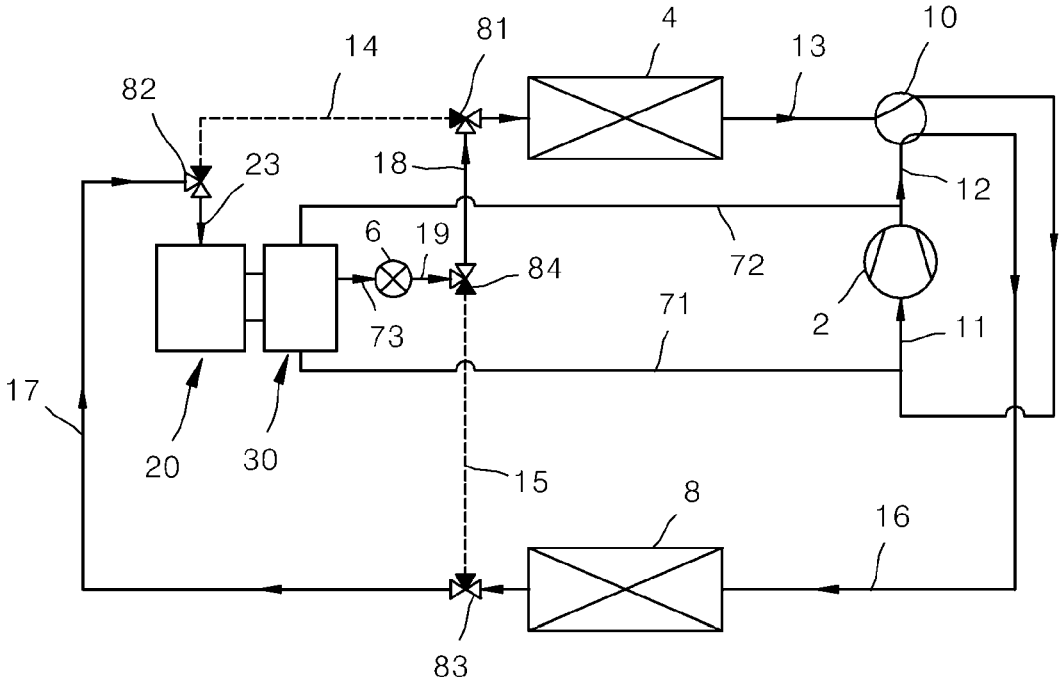

Referring to FIGS. 1 through 3, a heat pump system according to an embodiment of the present invention includes a compressor 2, an indoor heat exchanger 4, an expansion unit 6, an outdoor heat exchanger 8, a 4 way valve 10, a liquid receiver 20, and a liquid receiver valve 30.

Although the heat pump system is described as a cooling and heating system that is capable of performing both cooling and heating functions, the heat pump system may be a cooling device that is capable of performing only a cooling function or a heater that is capable of performing only a heating function. The indoor heat exchanger 4 serves as a condenser when the heating of the heat pump system is on, and the indoor heat exchanger 4 serves as an evaporator when the cooling of the heat pump system is on. The outdoor heat exchanger 8 serves as an evaporator when the heating of the heat pump system is on, and the outdoor heat exchanger 8 servers as a condenser when the cooling of the heat pump system is on.

A compressor suction flow path 11 is connection to an inlet of the compressor 2, and a compressor discharge flow path 12 is connected to an outlet of the compressor 2. The compressor suction flow path 11 is connected to the liquid receiver valve 30 via a first compressor connection flow path 71. The compressor discharge flow path 12 is connected to the liquid receiver valve 30 via a second compressor connection flow path 72.

One side of the indoor heat exchanger 4 is connected to the 4 way valve 10 via a first indoor heat exchanger flow path 13, and a second indoor heat exchanger flow path 14 is connected to the other side of the indoor heat exchanger 4. The second indoor heat exchanger flow path 14 guides a refrigerant condensed by the indoor heat exchanger 4 into the liquid receiver 20 when the heating of the heat pump system is on.

The outdoor heat exchanger 8 is connected to the 4 way valve 10 via the first outdoor heat exchanger flow path 16 and to the expansion unit 6 via the second outdoor heat exchanger flow path 15. The second outdoor heat exchanger flow path 15 guides the refrigerant expanded by the expansion unit 6 to the outdoor heat exchanger 8 when the heating of the heat pump system is on.

A third outdoor heat exchanger flow path 17 is connected to the second outdoor heat exchanger flow path 15 so as to transfer the refrigerant condensed by the outdoor heat exchanger 8 to the liquid receiver 20 when the cooling of the heat pump system is on. A third 3 way valve 83 that converts a flow path depending on cooling and heating operations is installed at a point where the second outdoor heat exchanger flow path 15 and the third outdoor heat exchanger flow path 17 are connected to each other.

An expansion unit discharge flow path 19 is connected to an outlet of the expansion unit 6. A third indoor heat exchanger flow path 18 that guides the refrigerant expanded by the expansion unit 6 to the indoor heat exchanger 4 when the cooling of the heat pump system is on, and the second outdoor heat exchanger flow path 15 that guides the refrigerant expanded by the expansion unit 6 to the outdoor heat exchanger 8 when the heating of the heat pump system is on, are connected to the expansion unit discharge flow path 19. A fourth 3 way valve 84 that converts a flow path depending on cooling and heating operations is installed at a point where the expansion unit discharge flow path 19, the third indoor heat exchanger flow path 18, and the second outdoor heat exchanger flow path 15 are connected to one another.

The third indoor heat exchanger flow path 18 is connected to the second indoor heat exchanger flow path 14. A first 3 way valve 81 that converts a flow path depending on cooling and heating operations is installed at a point where the third indoor heat exchanger flow path 18 and the second indoor heat exchanger flow path 14 are connected to each other.

The liquid receiver 20 is a tank that constitutes a storage space in which the refrigerant condensed by a condenser is temporarily stored. A liquid receiver suction flow path 23 is connected to the liquid receiver 20 so that the refrigerant condensed by the condenser can flow into the liquid receiver 20 via the liquid receiver suction flow path 23. That is, the liquid receiver suction flow path 23 is connected to the second indoor heat exchanger flow path 14 so that the refrigerant condensed by the indoor heat exchanger 4 can flow into the liquid receiver 20 via the liquid receiver suction flow path 23 when the heating of the heat pump system is on, and the liquid receiver suction flow path 23 is connected to the third outdoor heat exchanger flow path 17 so that the refrigerant condensed by the outdoor heat exchanger 8 can flow into the liquid receiver 20 via the liquid receiver suction flow path 23 when the cooling of the heat pump system is on. A second 3 way valve 82 that converts a flow path depending on cooling and heating operations is disposed at a point where the liquid receiver suction unit 23, the second indoor heat exchanger flow path 14 and the third outdoor heat exchanger flow path 17 are connected to one another.

Figure 4:
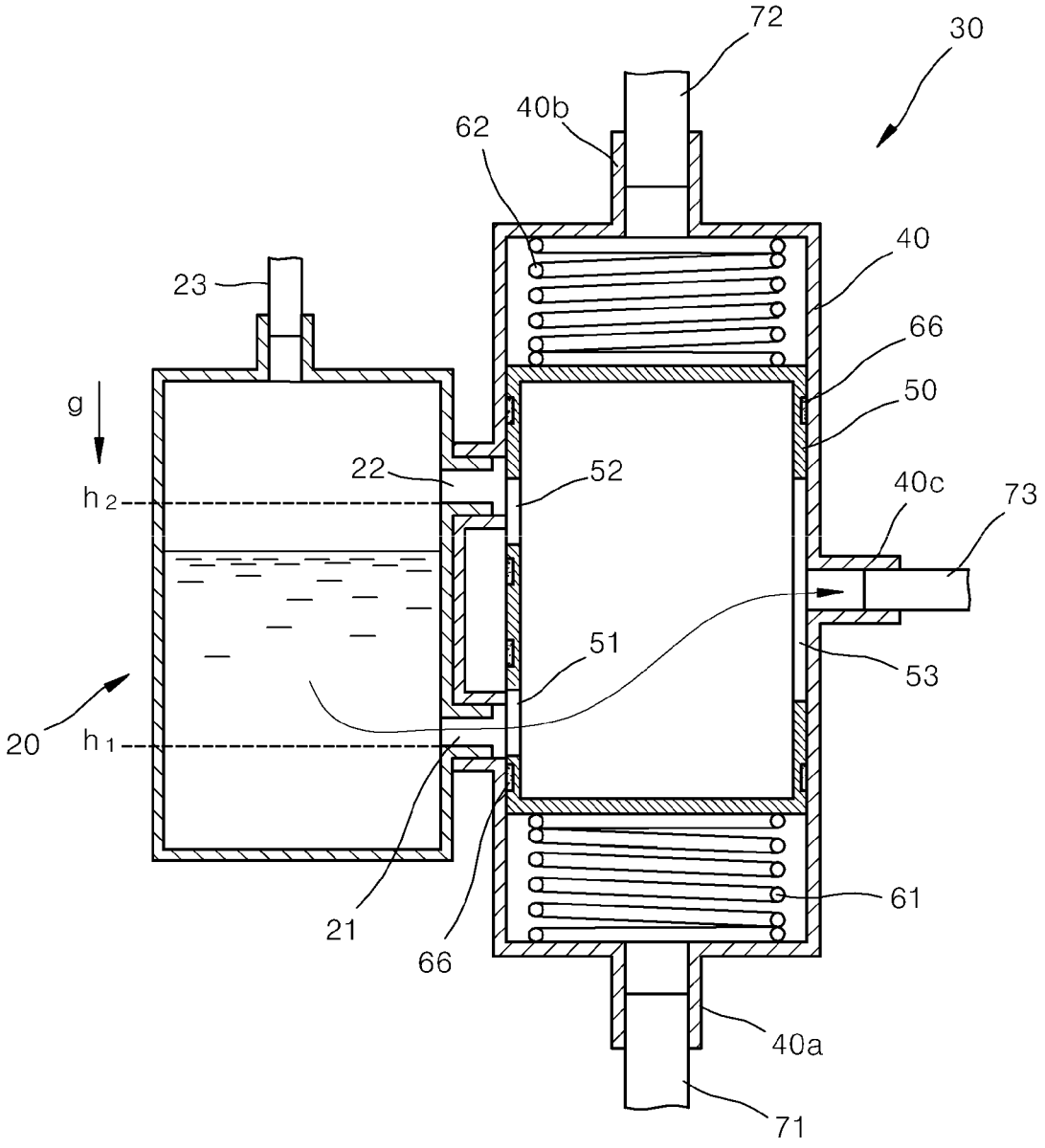
FIG. 4 is a cross-sectional view of a liquid receiver and a liquid receiver valve according to an embodiment of the present invention.

Referring to FIG. 4, the liquid receiver suction flow path 23 is connected to a top end of the liquid receiver 20. Thus, the refrigerant condensed by the condenser may flow into the liquid receiver 20 in a direction of gravity g.

A plurality of liquid receiver refrigerant outlets are formed at sides of the liquid receiver 20 so as to be spaced apart from each other by a predetermined gap in the direction of gravity g. Since at least two liquid receiver refrigerant outlets are formed, two liquid receiver refrigerant outlets are formed in the current embodiment. That is, the plurality of liquid receiver refrigerant outlets includes a low level refrigerant outlet 21 and a high level refrigerant outlet 22 that is formed at an upper side than the low level refrigerant outlet 21 in the direction of gravity g. A difference between heights of the low level refrigerant outlet 21 and the high level refrigerant outlet 22 may be determined in consideration of a storage capacity of the liquid receiver 20 and the circulation amount of the refrigerant that circulates the heat pump system. The amount of liquid stored in the liquid receiver 20 may vary according to the heights of the low level refrigerant outlet 21 and the high level refrigerant outlet 22, and the circulation amount of the refrigerant that circulates the heat pump system may vary according to the amount of the refrigerant stored in the liquid receiver 20. Thus, the heat pump system may respond to cooling and heating loads, by adjusting the circulation amount of the refrigerant that circulates the heat pump system according to the heights of the low level refrigerant outlet 21 and the high level refrigerant outlet 22. Also, when the circulation amount of the refrigerant that circulates the heat pump system is more finely adjusted, the number of liquid receiver refrigerant outlets may be increased.

The liquid receiver valve 30 adjusts the amount of the refrigerant discharged from the liquid receiver 20 by selectively opening the plurality of liquid receiver refrigerant outlets based on a pressure difference between an inlet and an outlet of the compressor 2. The liquid receiver valve 30 includes a valve cylinder 40, a valve piston 50, and first and second elastic members 61 and 62.

The valve cylinder 40 is connected to the liquid receiver 20 and has a shape of a hollow cylinder. In the current embodiment, the valve cylinder 40 is disposed beside the liquid receiver 20 in the direction of gravity g. However, embodiments of the present invention are not limited thereto, and if the valve cylinder 40 is connected to the liquid receiver 20 via a flow path, the valve cylinder 40 may be disposed far away from the liquid receiver 20 and may also be disposed in other directions than the direction of gravity g.

One side of the valve cylinder 40 communicates with the low level refrigerant outlet 21 and the high level refrigerant outlet 22 of the liquid receiver 20, and a cylinder outlet 40*c* through which the refrigerant is discharged to the expansion unit 6, is formed at the other side of the valve cylinder 40. An expansion unit connection flow path 73 is connected to the cylinder outlet 40*c* so as to guide the discharged refrigerant to the expansion unit 6.

The first compressor connection flow path 71 is connected to a lower portion 40*a* of the valve cylinder 40, and the second compressor connection flow path 72 is connected to an upper portion 40*b* of the valve cylinder 40. Thus, an inner lower portion of the valve cylinder 40 may be maintained with a pressure of an suction side of the compressor 2, and an inner upper portion of the valve cylinder 40 may be maintained with a pressure of a discharge side of the compressor 2. In the current embodiment, the valve cylinder 40 is disposed in a vertical direction. Thus, the first and second compressor connection flow paths 71 and 72 are connected to the upper and lower portions of the valve cylinder 40. However, embodiments of the present invention are not limited thereto, and the first and second compressor connection flow paths 71 and 72 may be connected to both sides of the valve cylinder 40, such as right and left sides of the valve cylinder 40 or front and rear sides of the valve cylinder 40.

A plurality of piston inlets are formed at one side of the valve piston 50, and a piston outlet 53 is formed at the other side of the valve piston 50, and the valve piston 50 has a hollow cylinder shape. The valve piston 50 is reciprocated in the valve cylinder 40 by a pressure difference between the upper and lower portions of the valve cylinder 40 and elastic forces of the first and second elastic members 61 and 62 that will be described later.

Figure 5:
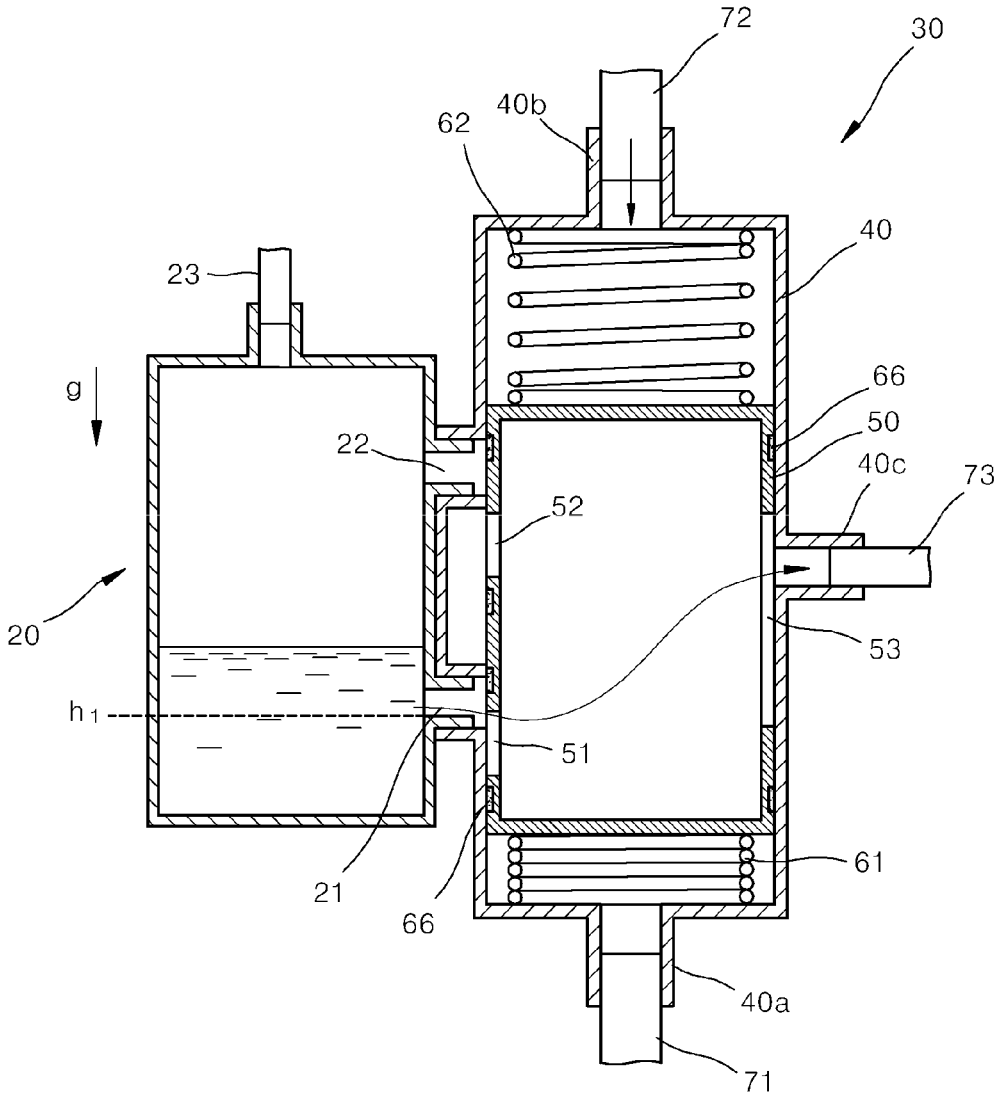
FIG. 5 is a view for describing a state in which the liquid receiver valve illustrated in FIG. 4 opens a low level refrigerant outlet.
Figure 6:
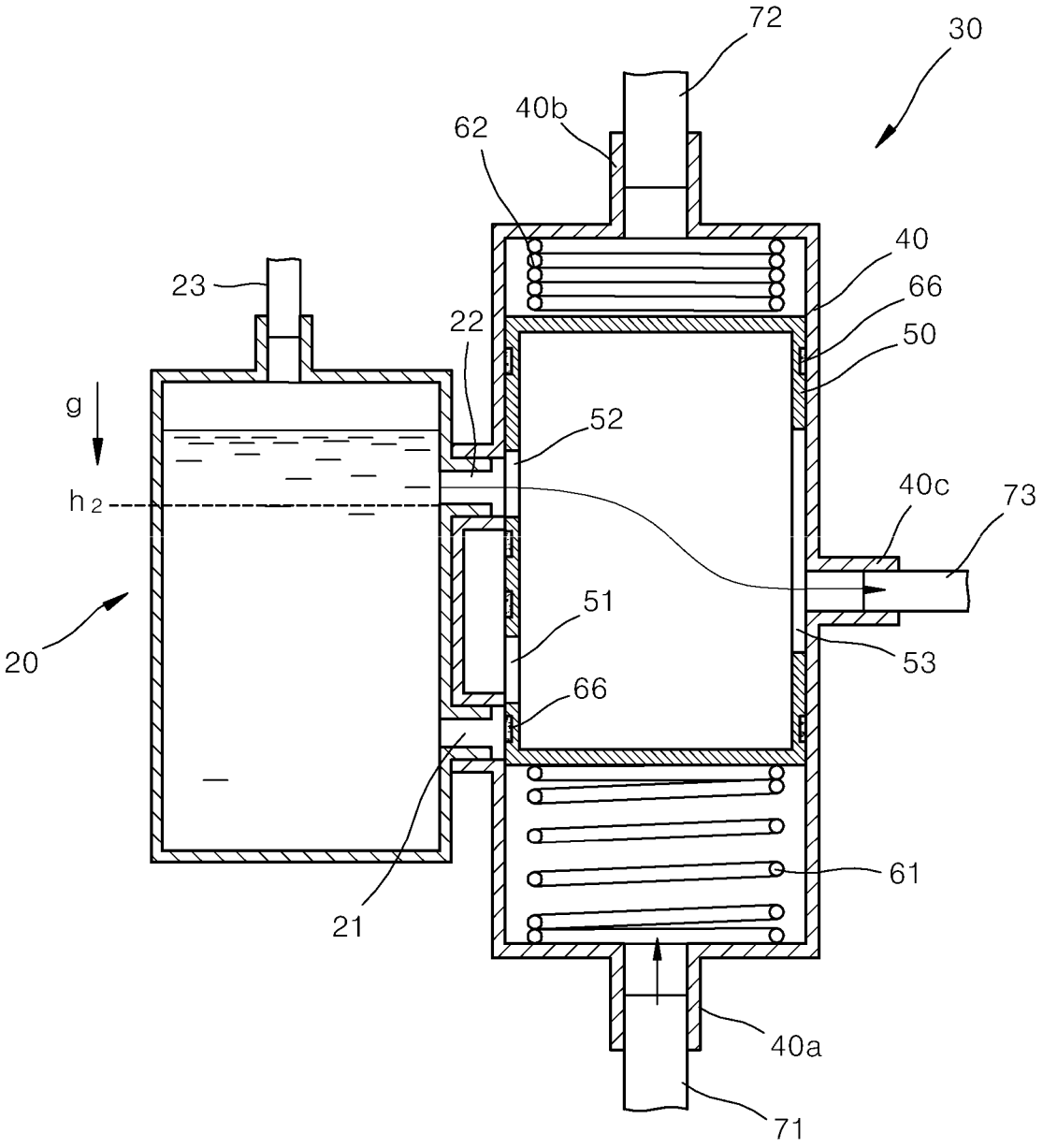
FIG. 6 is a view for describing a state in which the liquid receiver valve of FIG. 4 opens a high level refrigerant outlet.

The plurality of piston inlets are formed to correspond to the plurality of liquid receiver refrigerant outlets. In the current embodiment, two liquid receiver refrigerant outlets are formed. Thus, the piston inlets include two piston inlets, i.e., a low level piston inlet 51 and a high level piston inlet 52. The low level piston inlet 51 and the high level piston inlet 52 are formed to be spaced apart from each other by a predetermined gap in the direction of gravity g. A distance between the low level piston inlet 51 and the high level piston inlet 52 is smaller than a distance between the low level refrigerant outlet 21 and the high level refrigerant outlet 22. Thus, as illustrated in FIGS. 5 and 6, the high level refrigerant outlet 22 may be closed when the low level refrigerant outlet 21 is opened, and the low level refrigerant outlet 21 may be closed when the high level refrigerant outlet 22 is opened. The piston outlet 53 is formed to have a larger size than that of the cylinder outlet 40*c* so that, even when any one of the low level refrigerant outlet 21 and the high level refrigerant outlet 22 is opened, the piston outlet 53 may communicate with the cylinder outlet 40*c*.

A sealing member 66 is disposed between the valve piston 50 and the valve cylinder 40 so as to prevent leakage of the refrigerant.

The elastic members include the first elastic member 62 that connects a top end of the valve piston 50 and the upper portion of the valve cylinder 40, and the second elastic member 61 that connects a bottom end of the valve piston 50 and the lower portion of the valve cylinder 40. The second elastic member 61 supports the valve piston 50 to descend due to the pressure difference between the inlet and the outlet of the compressor 2, and the first elastic member 62 supports the valve piston 50 to ascend due to the pressure difference between the inlet and the outlet of the compressor 2. Compression coil springs may be used as the first elastic member 62 and the second elastic member 61.

Springs having different rigidity are used as the first elastic member 62 and the second elastic member 61. Referring to FIG. 4, when the pressure difference between the inlet and the outlet of the compressor 2 is within a predetermined setting range, the valve piston 50 needs to be maintained in a preset equilibrium state. Since the pressure of the outlet of the compressor 2 is always higher than the pressure of the inlet of the compressor 2, the second elastic member 61 having larger rigidity than that of the first elastic member 62 is used to maintain the equilibrium state. Thus, when the pressure difference between the inlet and the outlet of the compressor 2 is out of the predetermined setting range, the valve piston 50 may ascend or descend. The setting range is between a first setting value and a second setting value, and when the pressure difference between the inlet and the outlet of the compressor 2 is equal to or greater than the first setting value, the valve piston 50 descends due to a pressure of the upper portion of the valve cylinder 40, and when the pressure difference between the inlet and the outlet of the compressor 2 is equal to or less than the second setting value, the valve piston 50 may ascend due to a pressure of the lower portion of the valve cylinder 40.

An operation of the liquid receiver valve 30 having the above configuration according to an embodiment of the present invention will be described below.

First, referring to FIG. 4, when the compressor 2 operates at a driving speed within a predetermined reference speed range, the pressure difference between the inlet and the outlet of the compressor 2 is within the setting range. The setting range is between a predetermined first setting value and a second setting value that is smaller than the first setting value.

When the pressure difference between the inlet and the outlet of the compressor 2 is within the setting range, the pressure of the upper portion of the valve cylinder 40 is supported by the second elastic member 61, and the pressure of the lower portion of the valve cylinder 40 is supported by the first elastic member 62. Thus, the valve piston 50 may be maintained in the equilibrium state within the valve cylinder 40.

When the valve piston 50 is in the equilibrium state, the high level piston inlet 52 opens the high level refrigerant outlet 22, and the low level piston inlet 51 opens the low level refrigerant outlet 21. The refrigerant in the liquid receiver 20 flows into the valve piston 50 through the high level refrigerant outlet 22 and the low level refrigerant outlet 21 and then is discharged to the expansion unit 6 through the cylinder outlet 40*c*. Thus, a level of the refrigerant in the liquid receiver 20 may be maintained between a first level $h_1$ and a second level $h_2$.

When the compressor 2 is rotated at a high speed that is equal to or greater than a first setting speed due to increasing cooling and heating loads, the pressure of the outlet of the compressor 2 is increased, and the pressure difference between the inlet and the outlet of the compressor 2 is equal to or greater than the first setting value.

Referring to FIG. 5, when the pressure difference between the inlet and outlet of the compressor 2 is equal to or greater than the first setting value, the pressure of the upper portion of the valve cylinder 40 is increased, and the valve piston 50 descends.

When the valve piston 50 descends, the high level refrigerant outlet 22 is closed, and only the low level refrigerant outlet 21 is opened. When only the low level refrigerant outlet 21 is opened, the refrigerant in the liquid receiver 20 flows into the valve piston 50 through the low level refrigerant outlet 21 and then is discharged to the expansion unit 6. In this case, the refrigerant in the liquid receiver 20 is discharged through the low level refrigerant outlet 21 until the level of the liquid receiver 20 becomes the first level $h_1$. Thus, the amount of the refrigerant stored in the liquid receiver 20 may be decreased, and the amount of the refrigerant that circulates the heat pump system may be increased. Since the circulation amount of the refrigerant may be increased when the compressor 2 is rotated at a high speed, cooling and heating performance can be improved.

On the other hand, when the compressor 2 is rotated at speed that is less than the first setting speed and is equal to or greater than a second setting speed due to decreased cooling and heating loads, the pressure difference between the inlet and the outlet of the compressor 2 is within a setting range that is between the first setting value and the second setting value.

When the pressure difference between the inlet and the outlet of the compressor 2 is within the setting value, the pressure of the upper portion of the valve cylinder 40 may be supported by the second elastic member 61, as illustrated in FIG. 4. Thus, the valve piston 50 may be maintained in the equilibrium state.

When the valve piston 50 is in the equilibrium state, the high level piston inlet 52 opens the high level refrigerant outlet 22, and the low level piston inlet 51 opens the low level refrigerant outlet 21. Thus, when the compressor 2 is rotated at speed that is less than the first setting speed and is equal to greater than the second setting speed, the level of the refrigerant in the liquid receiver 20 may be maintained between the first level $h_1$ and the second level $h_2$.

On the other hand, when the compressor 2 is rotated at a low speed that is less than the second setting speed due to continuously-decreased cooling and heating loads, the pressure of the outlet of the compressor 2 is decreased. When the pressure of the outlet of the compressor 2 is decreased, the pressure difference between the inlet and the outlet of the compressor 2 is equal to or less than the second setting value.

When the pressure difference between the inlet and the outlet of the compressor 2 is equal to or less than the second setting value, the pressure of the upper portion of the valve cylinder 40 is decreased, and the valve piston 50 ascends, as illustrated in FIG. 6.

When the valve piston 50 ascends, the high level refrigerant outlet 22 is opened, and the low level refrigerant outlet 21 is closed. When only the high level refrigerant outlet 22 is opened and the level of the liquid receiver 20 is equal to or greater than the second level $h_2$, the refrigerant in the liquid receiver 20 may be discharged through the high level refrigerant outlet 22. Since the level of the liquid receiver 20 may be maintained to be equal to or greater than the second level $h_2$, the amount of the refrigerant stored in the liquid receiver 20 may be increased, and the amount of the refrigerant that circulates the heat pump system may be decreased. That is, when the compressor 2 is rotated at a low speed, the amount of the refrigerant that circulates the heat pump system needs to be decreased. Thus, the amount of the refrigerant stored in the liquid receiver 20 may be increased using the liquid receiver valve 30 so that the amount of the refrigerant that circulates the heat pump system can be decreased.

Thus, the amount of the refrigerant stored in the liquid receiver 20 is adjusted according to a rotation speed of the compressor 2 so that the circulation amount of the refrigerant that circulates the heat pump system can be increased/decreased and thus cooling and heating performance can be further improved.

As described above, a heat pump system according to the present invention includes a liquid receiver valve that adjusts the amount of a refrigerant stored in a liquid receiver so that a circulation amount of the refrigerant that circulates the heat pump system can be adjusted according to a driving speed of a compressor and performance of the compressor and the heat pump system can be further improved.

Also, since a plurality of liquid receiver refrigerant outlets can be selectively opened using a pressure difference between an inlet and an outlet of the compressor, active control can be performed.

In addition, since a water level of the liquid receiver can be adjusted in a multi-step manner according to heights of the plurality of liquid receiver refrigerant outlets, the amount of the refrigerant that circulates the heat pump system can be more precisely adjusted.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A heat pump system comprising:
a compressor;
a condenser;
an expansion unit; and
an evaporator,
further comprising:
a liquid receiver which is disposed so that a refrigerant condensed by the condenser flows into the liquid receiver in a direction of gravity and in which a plurality of liquid receiver refrigerant outlets are formed at sides of the liquid receiver so as to be spaced apart from each other by a predetermined gap in the direction of gravity; and
a liquid receiver valve that adjusts an amount of the refrigerant discharged from the liquid receiver by selectively opening the plurality of liquid receiver refrigerant outlets based on a pressure difference between an inlet and an outlet of the compressor,
wherein the liquid receiver valve comprises:
a valve cylinder, of which both sides are connected to the outlet and the inlet of the compressor, respectively;
a valve piston that is disposed in the valve cylinder and selectively opens the plurality of liquid receiver refrigerant outlets by moving based on a pressure difference between both sides of the valve cylinder; and
elastic members that elastically support the valve piston in the valve cylinder,
wherein a plurality of piston inlets are formed at one side of the valve piston so as to selectively communicate with the plurality of liquid receiver refrigerant outlets and to be spaced apart from each other by a predetermined gap, and a piston outlet that discharges the refrigerant flowing into the plurality of piston inlets to the expansion unit is formed at the other side of the valve piston.

2. The heat pump system of claim 1, wherein the number of piston inlets is formed to correspond to the number of liquid receiver refrigerant outlets, and
a distance between the plurality of piston inlets is smaller than a distance between the plurality of liquid receiver refrigerant outlets.

3. The heat pump system of claim 1, wherein a cylinder outlet is formed at the valve cylinder so as to communicate with the piston outlet and to be connected to the expansion unit via a flow path.

4. The heat pump system of claim 1, wherein the elastic members comprise:
a first elastic member that connects one side of the valve piston to one side of the valve cylinder; and
a second elastic member that connects the other side of the valve piston to the other side of the valve cylinder, and
the first elastic member and the second elastic member have different rigidity.

5. The heat pump system of claim 1, wherein the liquid receiver valve further comprises a sealing member that seals a space between the valve cylinder and the valve piston.

6. The heat pump system of claim 1, wherein the liquid receiver refrigerant outlets comprise a high level refrigerant outlet and a low level refrigerant outlet that is formed at a lower side than the high level refrigerant outlet.

7. A heat pump system comprising:
a compressor;
a condenser;
an expansion unit; and
an evaporator, further comprising:

a liquid receiver which is disposed so that a refrigerant condensed by the condenser flows into the liquid receiver in a direction of gravity and in which a plurality of liquid receiver refrigerant outlets are formed at sides of the liquid receiver so as to be spaced apart from each other by a predetermined gap in the direction of gravity; and a liquid receiver valve that adjusts an amount of the refrigerant discharged from the liquid receiver by selectively opening the plurality of liquid receiver refrigerant outlets based on a pressure difference between an inlet and an outlet of the compressor, wherein the liquid receiver valve comprises:

a valve cylinder, of which both sides are connected to the outlet and the inlet of the compressor, respectively;

a valve piston that is disposed in the valve cylinder and selectively opens the plurality of liquid receiver refrigerant outlets by moving based on a pressure difference between both sides of the valve cylinder; and elastic members that elastically support the valve piston in the valve cylinder, wherein the liquid receiver refrigerant outlets comprise a high level refrigerant outlet and a low level refrigerant outlet that is formed at a lower side than the high level refrigerant outlet, wherein, if the pressure difference between the inlet and the outlet of the compressor is equal to or greater than a first setting value, a pressure of a portion of the valve cylinder that is connected to the outlet of the compressor is increased so that the valve piston opens the low level refrigerant outlet by moving a direction in which pressure is relatively low.

8. The heat pump system of claim 7, wherein, if the pressure difference between the inlet and the outlet of the compressor is equal to or greater than a second setting value that is smaller than the first setting value, the pressure of the portion of the valve cylinder that is connected to the outlet of the compressor is reduced so that the valve piston opens only the high level refrigerant outlet by moving the direction in which pressure is relatively low.

9. The heat pump system of claim 1, further comprising a 4 way valve that converts a flow direction of the refrigerant depending on cooling and heating operations.

* * * * *